US005803054A

United States Patent [19]

Yamazaki et al.

[11] Patent Number: 5,803,054

[45] Date of Patent: Sep. 8, 1998

[54] EVAPORATIVE FUEL-PROCESSING SYSTEM FOR INTERNAL COMBUSTION ENGINES FOR VEHICLES

[75] Inventors: Kazumi Yamazaki; Teruo Wakashiro; Koichi Hidano; Takeshi Hara; Takeaki Nakajima, all of Wako, Japan

[73] Assignee: Honda Giken Kogyo Kabushiki Kaisha, Tokyo, Japan

[21] Appl. No.: 688,858

[22] Filed: Jul. 31, 1996

[30] Foreign Application Priority Data

Aug. 4, 1995 [JP] Japan ..... 7-218249

[51] Int. Cl.[6] ..... F02M 37/04

[52] U.S. Cl. ..... 123/519; 123/516

[58] Field of Search ..... 123/520, 519, 123/518, 521, 516, 198 D

[56] References Cited

U.S. PATENT DOCUMENTS

| | | | |
|---|---|---|---|
| 4,727,955 | 3/1988 | Honda | 123/519 |
| 4,787,643 | 11/1988 | Shirata | 123/519 |
| 4,793,839 | 12/1988 | Hayashida | 123/519 |
| 5,058,693 | 10/1991 | Murdock | 123/519 |
| 5,060,620 | 10/1991 | Oslapas | 123/519 |
| 5,317,909 | 6/1994 | Yamada | 123/520 |
| 5,327,873 | 7/1994 | Ohuchi | 123/520 |
| 5,427,076 | 6/1995 | Kobayashi | 123/520 |
| 5,437,257 | 8/1995 | Giacomazzi | 123/520 |
| 5,441,031 | 8/1995 | Kiyomiya | 123/520 |

FOREIGN PATENT DOCUMENTS

| | | | |
|---|---|---|---|
| 0192948 | 8/1988 | Japan | 123/519 |

*Primary Examiner*—Carl S. Miller

*Attorney, Agent, or Firm*—Nikaido, Marmelstein, Murray & Oram LLP

[57] ABSTRACT

An evaporative fuel-processing system for an internal combustion engine for use in a vehicle. A passage extends between the fuel tank and the intake passage, for guiding evaporative fuel generated in the fuel tank, for processing, across which a canister is arranged. A first passage and a second passage are connected to the canister. A first valve is arranged across the first passage to allow air to flow into the canister through the first passage and inhibit air containing evaporative fuel from being discharged from the canister through the first passage. A second valve is arranged across the second passage to inhibit air from flowing into the canister through the second passage and allow air containing evaporative fuel to be discharged from the canister through the second passage. A filter is arranged in the first passage.

3 Claims, 3 Drawing Sheets

EVAPORATIVE FUEL-PROCESSING SYSTEM FOR INTERNAL COMBUSTION ENGINES FOR VEHICLES

BACKGROUND OF THE INVENTION

1. Field of the Invention

This invention relates to an evaporative fuel-processing system for internal combustion engines for vehicles, which processes evaporative fuel generated in the fuel tank of the engine installed in a vehicle.

2. Prior Art

Conventionally, an internal combustion engine (hereinafter referred to as "the engine") is provided with an evaporative fuel-processing system which prevents evaporative fuel generated in the fuel tank from being emitted into the atmosphere. Generally, in the conventional evaporative fuel-processing system, a passage extends between the fuel tank and the intake passage of the engine, with one end thereof opening into the intake passage at a location downstream of a throttle valve arranged therein. Further, a canister having an air communication port, and a purge control valve are arranged across the passage extending between the fuel tank and the intake passage, in this order from the fuel tank side to the intake passage side.

Conventional evaporative fuel-processing systems of this kind include one known, for example, from U.S. Pat. No. 5,427,076. According to the known evaporative fuel-processing system, a drain passage is connected at one end thereof to the air communication port of the canister, the other end of which is connected to a first passage and a second passage. The first passage extends from the drain passage to a space defined by a side frame of a chassis of a vehicle in which the engine is installed, and has a check valve arranged therein, for allowing air to flow into the canister. The second passage extends from the drain passage into the engine room of the vehicle and has a check valve arranged therein, for allowing evaporative fuel to be discharged from the canister.

Evaporative fuel generated in the fuel tank is temporarily adsorbed by the canister, and when the purge control valve is opened, evaporative fuel is purged from the canister, together with fresh air introduced through the air communication port into the canister, into the intake passage by utilizing negative pressure within the intake passage at a location downstream of the throttle valve.

The canister as mentioned above is generally arranged in the engine room of the vehicle. However, to effectively utilize a dead space within the vehicle, the canister is sometimes arranged in a recess for use as a spare wheel pan of the vehicle. Alternatively, the canister, if it has a large size according to a recent trend, is arranged in a space under a rear body etc. of the chassis since the canister cannot be accommodated in the engine room due to its large size. In such alternative case, the first passage which is connected to the air communication port of the canister through the drain passage, is disposed to open into an upper portion of the space under the rear body, for drawing fresh and clean air from the space, and the second passage is disposed to open into a lower portion of the space under the rear body, for discharging evaporative fuel into the space.

According to the conventional evaporative fuel-processing system with the canister arranged in the space under the rear body, however, even if the first passage is disposed to open into the upper portion of the space under the rear body, it is unavoidable that dust or trash is drawn through the first passage into the drain passage, resulting in clogging of the drain passage.

Consequently, if evaporative fuel is generated in the fuel tank in large quantities, air containing evaporative fuel is not emitted through the drain passage extending from the canister, so that pressure within the canister increases. As a result, particularly in an evaporative fuel-processing system in which evaporative fuel is adsorbed by the canister during refueling, refueling cannot smoothly take place.

SUMMARY OF THE INVENTION

It is the object of the invention to provide an evaporative fuel-processing system for internal combustion engines for vehicles, which is capable of preventing the drain passage from being completely clogged by dust or trash even when dust or trash is drawn into the drain passage connected to the canister, and at least capable of ensuring communication through a passage for discharging air containing evaporative fuel from the canister.

To attain the above object, the present invention provides an evaporative fuel-processing system for an internal combustion engine for use in a vehicle, the engine having an intake passage and a fuel tank, comprising:

a passage extending between the fuel tank and the intake passage, for guiding evaporative fuel generated in the fuel tank, for processing;

a canister arranged across the passage;

a first passage connected to the canister;

a second passage connected to the canister;

a first valve arranged across the first passage, for allowing air to flow into the canister through the first passage and for inhibiting air containing evaporative fuel from being discharged from the canister through the first passage;

a second valve arranged across the second passage, for inhibiting air from flowing into the canister through the second passage and for allowing air containing evaporative fuel to be discharged from the canister through the second passage; and a filter arranged in the first passage.

In a preferred embodiment of the invention, the evaporative fuel-processing system comprises:

a passage extending between the fuel tank and the intake passage, for guiding evaporative fuel generated in the fuel tank, for processing;

a canister arranged across the passage, the canister having an air communication port;

a drain passage connected to the air communication port;

a first passage connected to the drain passage;

a second passage connected to the drain passage;

a first valve arranged across the first passage, for allowing air to flow into the canister through the first passage and the air communication port and for inhibiting air containing evaporative fuel from being discharged from the canister through the air communication port and the first passage;

a second valve arranged across the second passage, for inhibiting air from flowing into the canister through the second passage and the air communication port and for allowing air containing evaporative fuel to be discharged from the canister through the air communication port and the second passage; and a filter arranged in the first passage.

In another preferred embodiment of the invention, the evaporative fuel-processing system comprises:

a passage extending between the fuel tank and the intake passage, for guiding evaporative fuel generated in the fuel tank, for processing;

a canister arranged across the passage, the canister having an air communication port;

a first passage connected to the air communication port;

a second passage connected to the air communication port;

a first valve arranged at a junction of the first passage with the air communication port and directly connected to the air communication port, for allowing air to flow into the canister through the first passage and the air communication port and for inhibiting air containing evaporative fuel from being discharged from the canister through the air communication port and the first passage;

a second valve arranged at a junction of the second passage with the air communication port and directly connected to the air communication port, for inhibiting air from flowing into the canister through the second passage and the air communication port and for allowing air containing evaporative fuel to be discharged from the canister through the air communication port and the second passage; and a filter arranged in the first passage.

Preferably, in the above preferred embodiments, a distal end of the first passage has the filter arranged therein and opens into the space at a location relatively upper portion of the rear body, and a distal end of the second passage opens into the space at a location relatively lower portion of the rear body.

The above and other objects, features, and advantages of the invention will be more apparent from the following detailed description taken in conjunction with the accompanying drawings.

DETAILED DESCRIPTION

The invention will now be described in detail with reference to drawings showing embodiments thereof.

Figure 1:
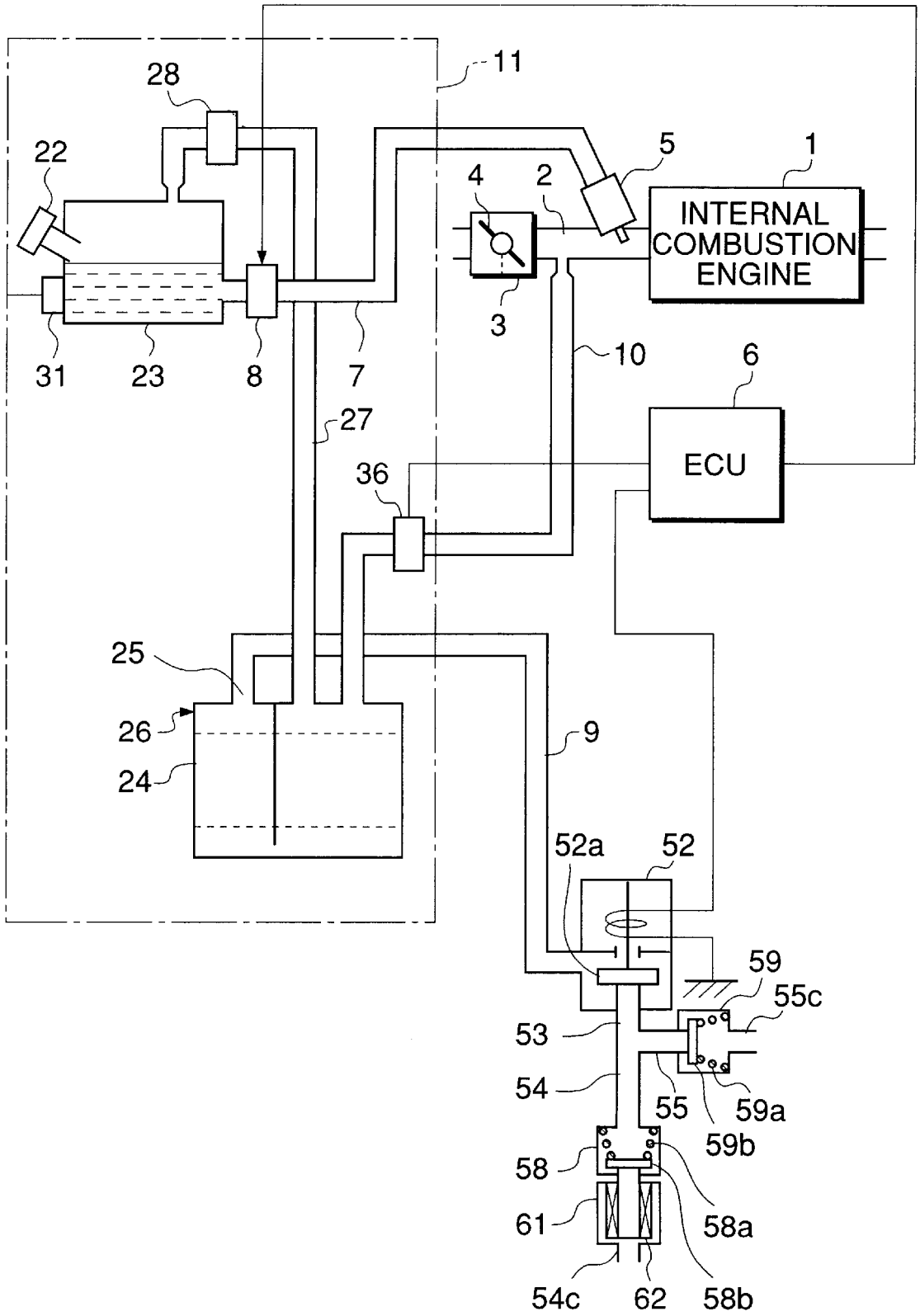
FIG. 1 is a schematic diagram showing the arrangement of an evaporative fuel-processing system for an internal combustion engine for an automotive vehicle, according to a first embodiment of the invention.

Referring first to FIG. 1, there is schematically shown the whole arrangement of an internal combustion engine and an evaporative fuel-processing system therefor, according to an embodiment of the invention. In the figure, reference numeral 1 designates an internal combustion engine (hereinafter referred to as "the engine") having, e.g. four cylinders, mounted in an automotive vehicle, not shown. The engine 1 has an intake passage 2 connected to the cylinder block thereof, across which is arranged a throttle body 3 accommodating a throttle valve 4 therein.

Fuel injection valves 5, only one of which is shown, are each inserted into the interior of the intake passage 2 at a location intermediate between the cylinder block of the engine 1 and the throttle valve 4 and slightly upstream of an intake valve, not shown. The fuel injection valves 5 are connected to a fuel pump 8 via a fuel supply pipe 7, and electrically connected to the ECU 6 to have their valve opening periods controlled by signals therefrom. A purging passage 10 opens into the intake passage 2 at a location downstream of the throttle valve 4, which is connected to an evaporative emission control system 11, referred to below.

The evaporative emission control system 11 is comprised of a fuel tank 23 having a filler cap 22 which is removed for refueling, a canister 26 accommodating activated carbon 24 therein as an adsorbent and having an air communication port 25 provided in a top wall thereof, a charging passage 27 connecting between the canister 26 and the fuel tank 23, a two-way valve 28 arranged across the charging passage 27, the purging passage 10 connecting between the canister 26 and the intake passage 2, and a purge control valve 36 arranged across the purging passage 10.

The purge control valve 36 is electrically connected to the ECU 6.

A drain passage 9 is connected to the air communication port 25 of the canister 26 and communicates with the atmosphere. A vent shut valve 52 is arranged across the passage 9. The vent shut valve 52 is formed by a normally-open type electromagnetic valve which is electrically connected to the ECU 6. The vent shut valve 52 has a valve element 52*a* displaceable by a driving signal from the ECU 6 to connect and disconnect between the drain passage 9 and a drain passage 53. When no signal is supplied from the ECU 6, the valve element 52*a* is biased by a spring, not shown, to keep the vent shut valve 52 open. The drain passage 53 extends from the vent shut valve 52 and is bifurcated into an inlet passage 54 and an outlet passage 55 across which one-way valves 58 and 59 are arranged, respectively. The inlet passage 54 and the outlet passage 55 terminate at respective locations under the atmospheric pressure, referred to hereinafter. The one-way valves 58 and 59 have valve elements 58*b* and 59*b* biased by springs 58*a* and 59*a* in directions of closing the valves, respectively. However, the valve elements 58*b* and 59*b* are disposed to open the respective passages 54 and 55 under opposite pressure conditions. That is, when the pressure within the passage 53 is lower than the atmospheric pressure, the one-way valve 58 opens, whereas, when the pressure within the passage 53 is higher than the atmospheric pressure, the one-way valve 59 opens. In other words, the one-way valve 58 allows air to flow into the canister 26 and inhibits evaporative fuel from being discharged from the canister 26. On the other hand, the one-way valve 59 inhibits air flowing into the canister 26 and allows evaporative fuel to be discharged from the canister 26.

A filter box 61 is arranged at a distal end of the inlet passage 54, which accommodates therein a cylindrical drain filter 62 formed by a mesh-like material. Air drawn through the distal end of the inlet passage 54 enters and passes the drain filter 62 through the peripheral surface thereof toward the one-way valve 58.

Figure 2:
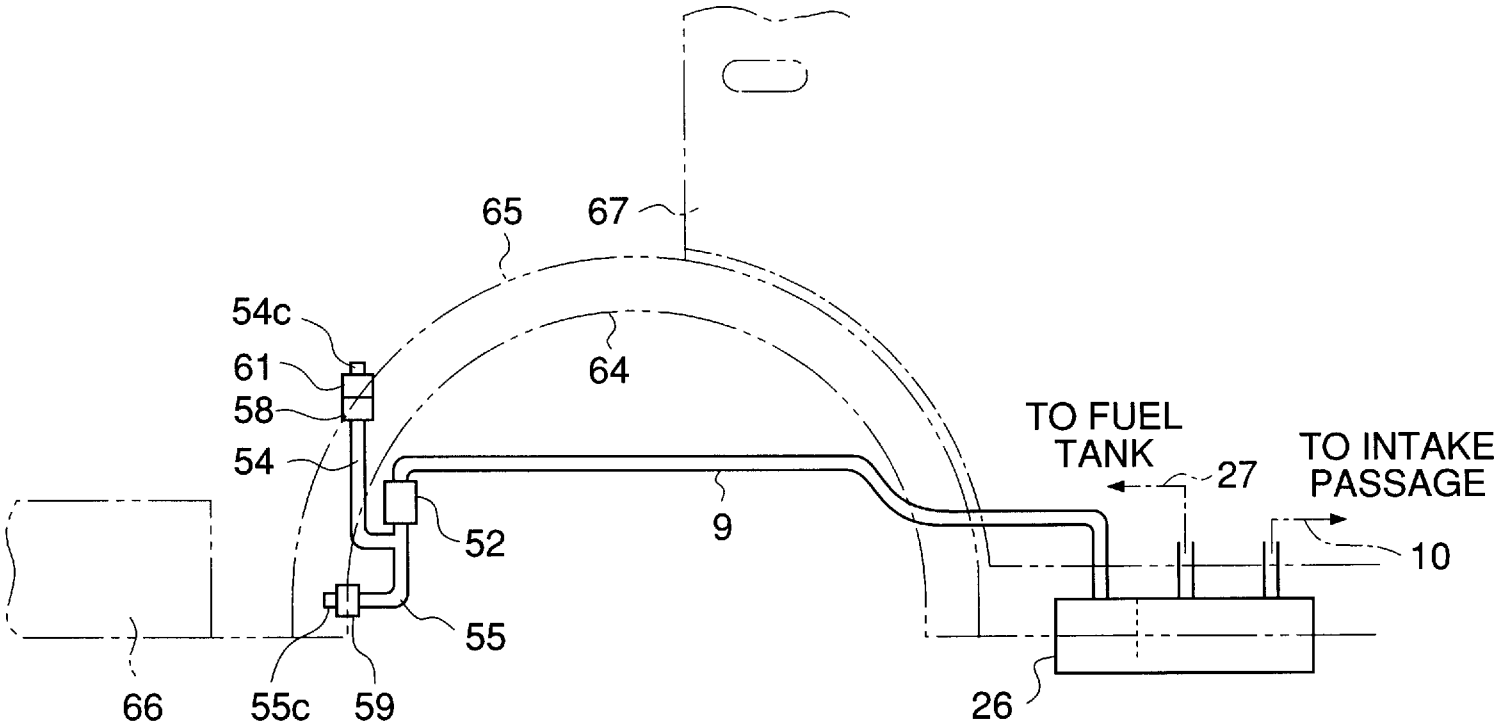
FIG. 2 is a schematic view showing the arrangement of essential parts of the evaporative fuel-processing system mounted in a chassis of the automotive vehicle.

FIG. 2 schematically shows essential parts of the evaporative fuel-processing system mounted in a chassis of the vehicle. In the figure, elements and parts appearing in FIG. 1 are designated by identical reference numerals, description of which is omitted.

In FIG. 2, reference numerals 64, 65, 66, and 67 designate component parts of the chassis of the vehicle, i.e. 64 designates a rear fender of the vehicle, 65 a rear wheel house of the chassis, 66 a bumper of the vehicle, and 67 a rear door of the chassis, respectively.

The canister 26 is arranged under a rear body of the chassis at a location forward of the rear wheel house 65. The vent shut valve 52 is located at a location inwardly adjacent a rear portion of the rear wheel house 65. The one-way valve 58, which is arranged near the distal end of the inlet passage 54, and the filter box 61 accommodating the drain filter 62 therein are located at a location inwardly adjacent an upper rear portion of the rear wheel house 65, and the one-way valve 59 arranged near a distal end of the outlet passage 55 is located at a location inwardly adjacent a lower rear portion of the rear wheel house 65. The distal end 54*c* of the inlet passage 54 near which the one-way valve 58 is mounted across the inlet passage 54 upwardly opens into a space at the location inwardly adjacent the upper rear portion of the rear wheel house 65, which communicates with the atmosphere.

The distal end 55*c* of the outlet passage 55 near which the one-way valve 59 is mounted across the output passage 55 rearwardly opens into a space at the location inwardly adjacent the lower rear portion of the rear wheel house 65, which also communicates with the atmosphere.

Next, how air is taken into and discharged from the evaporative fuel-processing system through the passage arrangement open to the atmosphere, constructed as above, will be described hereinbelow:

Evaporative fuel from the fuel tank 23 is normally adsorbed by the canister 26, since the vent shut valve 52 is normally kept open with no supply of the driving signal from the ECU 6. Since the vent shut valve 52 is kept open, the one-way valve 59 opens by relatively high pressure within the drain passage 53, and air containing evaporative fuel discharged from the canister 26 through the air communication port 25 is introduced through the drain passage 9, the vent shut valve 52, the drain passage 53, the outlet passage 55 and the one-way valve 59 to be discharged into the space inwardly adjacent the lower rear portion of the rear wheel house 65 through the distal end 55*c* of the outlet passage 55. Therefore, even if evaporative fuel is temporarily generated in the fuel tank 23 in such a large amount as exceeds the adsorbing capacity of the canister 26, e.g. in summer, part of evaporative fuel which is not adsorbed by the canister 26 is discharged through the above-mentioned discharge system into the space inwardly adjacent the lower rear space within the rear wheel house 65.

To desorb evaporative fuel from the canister 26, the purge control valve 36 is opened in response to a driving signal from the ECU 6, to thereby allow evaporative fuel to be purged from the canister 26 via the purging passage 10 to the engine 1. On this occasion, the driving signal is not supplied from the ECU 6 to the vent shut valve 52 to keep the vent shut valve 52 open, and accordingly the pressure within the drain passage 53 lowers so that the one-way valve 58 opens. Then, air is drawn from the space inwardly adjacent the upper rear portion of the rear wheel house 65 via the distal end 54*c* of the inlet passage 54 and then introduced through the filter box 61 with the drain filter 62 therein, the one-way valve 58, the inlet passage 54, the drain passage 53, the vent shut valve 52, and the drain passage 9, into the canister 26.

The air drawn from the space inwardly adjacent the upper rear portion of the rear wheel house 65 may contain dust or trash, which, however, are removed by the drain filter 62. Thus, dust or trash can be prevented from entering the drain passages 53 and 9, to thereby avoid clogging of a filter provided in the canister 26 with dust or trash, and degradation of the sealing performance of the valves. Further, the drain passages 9 and 53 can be prevented from being completely clogged, to thereby always ensure communication at least through the outlet passage 55.

Figure 3:
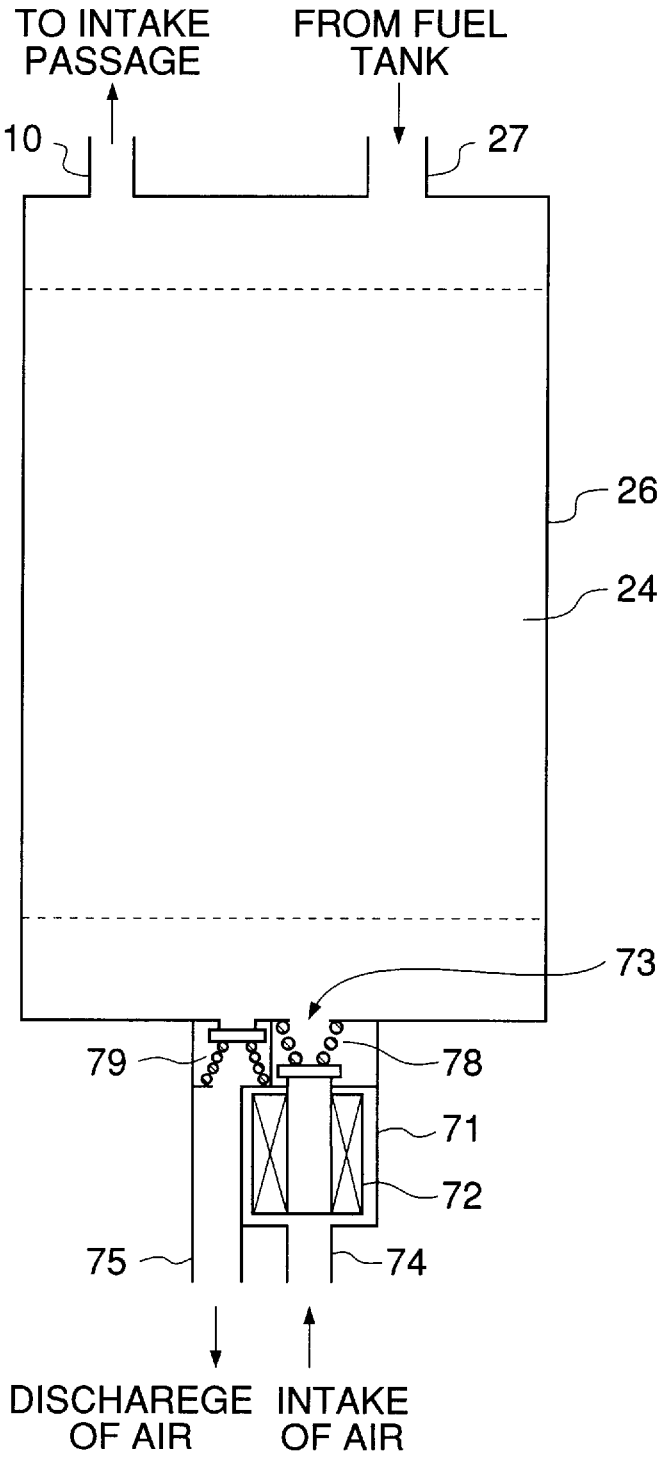
FIG. 3 is a schematic fragmentary view showing the arrangement of an evaporative fuel-processing system according to a second embodiment of the invention.

FIG. 3 shows the arrangement of an evaporative fuel-processing system according to a second embodiment of the invention. Elements and parts of the second embodiment corresponding to those in the first embodiment are designated by identical reference numerals, description of which is omitted.

According to the second embodiment, an air communication port 73 is arranged in a bottom surface of the canister 26, and an inlet passage 74 and an outlet passage 75 are mounted integrally on a casing of the canister 26 in a fashion being directly connected to the air communication port 73. A one-way valve 78 having the same function as that of the one-way valve 58 is arranged in an end portion of the inlet passage 74, at which the inlet passage 74 is connected to the air communication port 73. A one-way valve 79 having the same function as that of the one-way valve 59 is arranged in an end portion of the outlet passage 75, at which the outlet passage 75 is connected to the air communication port 73.

A filter box 71 and a drain filter 72 having the same functions and constructions as those of the filter box 61 and the drain filter 62 in the first embodiment are arranged in the inlet passage 74 on an air-inlet side of the one-way valve 78 remote from the air communication port 73, in a fashion similar to the first embodiment.

Except for the arrangement described above, the arrangement of the evaporative fuel-processing system according to the present embodiment is similar to the arrangement of the first embodiment. That is, the canister 26 is arranged in a space under the rear body of the chassis at a location forward of the rear wheel house, a distal end of the inlet passage 74 opens into a space inwardly adjacent an upper rear portion of the rear wheel house and communicating with the atmosphere, and a distal end of the outlet passage 75 opens into a space inwardly adjacent a lower rear portion of the rear wheel house.

According to the present embodiment, since the one-way valves 78 and 79 and the drain filter 72 are directly mounted on the casing of the canister 26, drain passages corresponding to the drain passages 9 and 54 of the first embodiment, to which are otherwise commonly connected the inlet passage 74 and the outlet passage 75 can be dispensed with, whereby communication through the outlet passage 75 can be always ensured even if the inlet passage 74 is clogged.

In the embodiments described above, in place of the one-way valves 58 and 59 in the first embodiment, or the one-way valves 78 and 79 in the second embodiment, electromagnetic valves may be employed for opening and closing the inlet passage 54 and the outlet passage 55, or the inlet passage 74 and the outlet passage 75 in response to driving signals from the ECU 6.

What is claimed is:

1. An evaporative fuel-processing system for an internal combustion engine for use in a vehicle, said engine having an intake passage and a fuel tank, comprising:

a passage extending between said fuel tank and said intake passage, for guiding evaporative fuel generated in said fuel tank, for processing;

a canister arranged across said passage;

a first passage connected to said canister;

a second passage connected to said canister;

a first valve arranged across said first passage, for allowing air to flow into said canister through said first passage and for inhibiting air containing evaporative fuel from being discharged from said canister through said first passage;

a second valve arranged across said second passage, for inhibiting air from flowing into said canister through said second passage and for allowing air containing evaporative fuel to be discharged from said canister through said second passage; and a filter arranged in said first passage, wherein said vehicle has a chassis including a wheel house defining a space located inwardly thereof, said first and second passages having respective distal ends, said distal end of said first passage having said filter arranged therein and opening into said space at a relatively upper portion of said space, said distal end of said second passage opening into said space at a relatively lower portion of said space.

2. An evaporative fuel-processing system for an internal combustion engine for use in a vehicle, said engine having an intake passage and a fuel tank, comprising:

a passage extending between said fuel tank and said intake passage, for guiding evaporative fuel generated in said fuel tank, for processing;

a canister arranged across said passage, said canister having an air communication port;

a drain passage connected to said air communication port;

a first passage connected to said drain passage;

a second passage connected to said drain passage;

a first valve arranged across said first passage, for allowing air to flow into said canister through said first passage and said air communication port and for inhibiting air containing evaporative fuel from being discharged from said canister through said air communication port and said first passage;

a second valve arranged across said second passage, for inhibiting air from flowing into said canister through said second passage and said air communication port and for allowing air containing evaporative fuel to be discharged from said canister through said air communication port and said second passage; and a filter arranged in said first passage, wherein said vehicle has a chassis including a wheel house defining a space located inwardly thereof, said first and second passages having respective distal ends, said distal end of said first passage having said filter arranged therein and opening into said space at a relatively upper portion of said space, said distal end of said second passage opening into said space at a relatively lower portion of said space.

3. An evaporative fuel-processing system for an internal combustion engine for use in a vehicle, said engine having an intake passage and a fuel tank, comprising:

a passage extending between said fuel tank and said intake passage, for guiding evaporative fuel generated in said fuel tank, for processing;

a canister arranged across said passage, said canister having an air communication port;

a first passage connected to said air communication port;

a second passage connected to said air communication port;

a first valve arranged at a junction of said first passage with said air communication port and directly connected to said air communication port, for allowing air to flow into said canister through said first passage and said air communication port and for inhibiting air containing evaporative fuel from being discharged from said canister through said air communication port and said first passage;

a second valve arranged at a junction of said second passage with said air communication port and directly connected to said air communication port, for inhibiting air from flowing into said canister through said second passage and said air communication port and for allowing air containing evaporative fuel to be discharged from said canister through said air communication port and said second passage; and a filter arranged in said first passage, wherein said vehicle has a chassis including a wheel house defining a space located inwardly thereof, said first and second passages having respective distal ends, said distal end of said first passage opening into said space at a relatively upper portion of said space, said distal end of said second passage opening into said space at a relatively lower portion of said space.

* * * * *